United States Patent [19]

Dillingham

[11] Patent Number: 4,485,855

[45] Date of Patent: Dec. 4, 1984

[54] BAG FILLING KIT

[76] Inventor: Julia E. Dillingham, 503 W. Whitaker Mill Rd., Raleigh, N.C. 27608

[21] Appl. No.: 583,017

[22] Filed: Feb. 23, 1984

Related U.S. Application Data

[63] Continuation of Ser. No. 376,918, May 10, 1982, abandoned.

[51] Int. Cl.[3] ..... B65B 39/06

[52] U.S. Cl. ..... 141/316; 141/390; 206/223; 248/99

[58] Field of Search ..... 141/1–12, 141/98, 114, 166, 285–310, 313–317, 369–381, 390, 391, 392; 248/95–101; 220/1 C, 404; 206/223; 222/460, 461, 462, 569, 570

[56] References Cited

U.S. PATENT DOCUMENTS 4,133,356 1/1979 Dillingham ..... 141/390

4,248,278 2/1981 Blodgett ..... 141/390

*Primary Examiner*—Houston S. Bell, Jr.

*Attorney, Agent, or Firm*—Daniel Jay Tick

[57] ABSTRACT

A bag filling kit has a hollow stand having side walls and spaced opposite first and second open ends. The stand is circular at its second open end. A funnel, separate and independent from the stand, has side walls, spaced opposite first and second open ends, a funnel neck at the second end and a clamping device at the funnel neck. The side walls taper down from the first end to the second end and the clamping device is dimensioned to fit over the second end of the stand and releasably clamp the neck of a flexible bag to the outside of the second end of the stand with the remainder of the bag in the stand when the neck of the bag is bent over the outside of the stand neck. The bag is thus fillable with material via the funnel when the funnel neck is inserted into the open neck of the bag.

4 Claims, 5 Drawing Figures

BAG FILLING KIT

This application is a continuation of application Ser. No. 376,918, filed 5/10/82, now abandoned.

BACKGROUND OF THE INVENTION

The present invention relates to a bag filling kit.

Although various bag support and filling arrangements have been developed and are described in the published prior art, most of them are for use in machinery, and are not suitable for use in the home for filling a freezer bag with occasional small quantities of material. A device of this type is described in U.S. Pat. No. 2,758,764 of Piazze, for example.

The present invention is an improvement over the bag filling kit disclosed in my U.S. Pat. No. 4,133,356, granted Jan. 9, 1979.

The principal object of the invention is to overcome the limitations and disadvantages of the bag filling devices of the prior art.

An object of the invention is to provide a bag filling kit improved in design and construction.

Another object of the invention is to provide a bag filling kit consisting of simple, durable, parts and components of simple structure, which are inexpensive in manufacture.

Still another object of the invention is to provide a bag filling kit which is usable with facility, convenience and rapidity by anyone, skilled or unskilled, without the need for tools.

Yet another object of the invention is to provide a bag filling kit which is an improvement over the bag filling kit disclosed in my U.S. Pat. No. 4,133,356.

Another object of the invention is to provide a bag filling kit which is of more simple structure and has fewer parts than the bag filling kit disclosed in my U.S. Pat. No. 4,133,356.

Still another object of the invention is to provide a bag filling kit which is used with greater facility, greater convenience and greater rapidity than the bag filling kit disclosed in my U.S. Pat. No. 4,133,356 by anyone, skilled or unskilled, without the need for tools.

BRIEF SUMMARY OF THE INVENTION

In accordance with the invention, a bag filling kit comprises a hollow stand having side walls and spaced opposite first and second open ends. The second end of the stand tapering down to a stand neck smaller than the first end and the stand is circular at its second open end. A funnel has side walls, spaced opposite first and second open ends, a funnel neck at the second end and a clamping device at the funnel neck. The side walls taper down from the first end to the second end and the clamping device is dimensioned to fit over the second end of the stand and releasably clamp the neck of a flexible bag to the outside of the second end of the stand with the remainder of the bag in the stand when the neck of the bag is bent over the outside of the stand neck. The bag is thereby fillable with material via the funnel when the funnel neck is inserted into the open neck of the bag. The funnel is separate and independent from the stand.

The clamping device of the funnel comprises a coaxial collar spaced from and around the funnel neck. The funnel neck has dimensions small enough to fit into the stand neck and the collar has dimensions large enough to fit around the stand neck.

The stand is square at its first open end.

The collar is spaced from the funnel neck by an annular gap having a radial thickness sufficient to accommodate the stand neck and the neck of the bag in a substantially snug fit.

The stand has slots formed in a pair of opposite ones of the side walls. A shelf is removably insertable into the stand via the slots and supported by the side walls.

The shelf has a substantially planar surface bounded by a front edge, a rear edge and a pair of side edges. A trough-like pull member extends from the front edge for facilitating manual movement of the shelf.

The pull member is integrally formed with the shelf and has a rear side extending from the front edge of the shelf substantially perpendicularly thereto, a front side in spaced parallel relation with the rear side and a top side in spaced parallel relation with the planar surface of the shelf and joining the front and rear sides.

The side walls of the stand include an additional pair of opposite side walls bounding the ones of the side walls. The slots extend the full distance between the additional side walls and the front and rear edges of the shelf are spaced a greater distance than the distance between the ones of the side walls.

BRIEF DESCRIPTION OF THE DRAWINGS

In order that the invention may be readily carried into effect, it will now be described with reference to the accompanying drawings, wherein.

Figure 2:
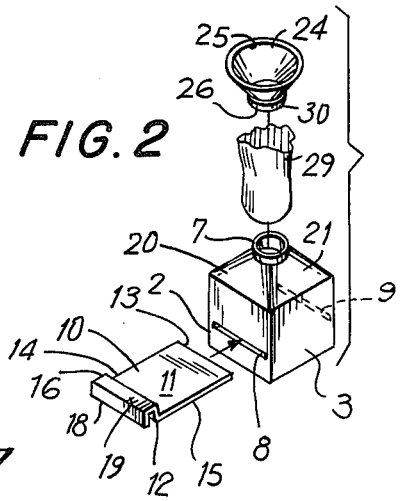
FIG. 2 is a perspective view, on a reduced scale, of the embodiment of FIG. 1.
Figure 3:
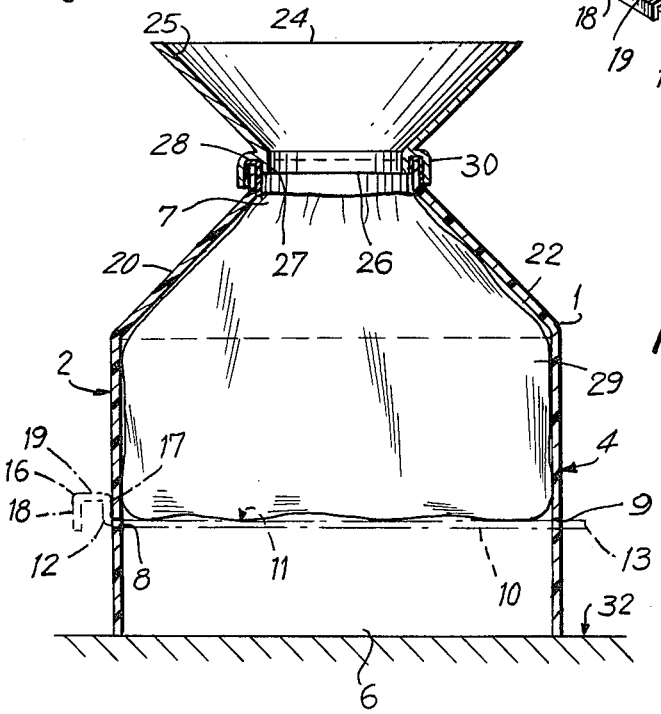
FIG. 3 is a sectional view, on an enlarged scale, taken along the lines III—III, of FIG. 1.
Figure 4:
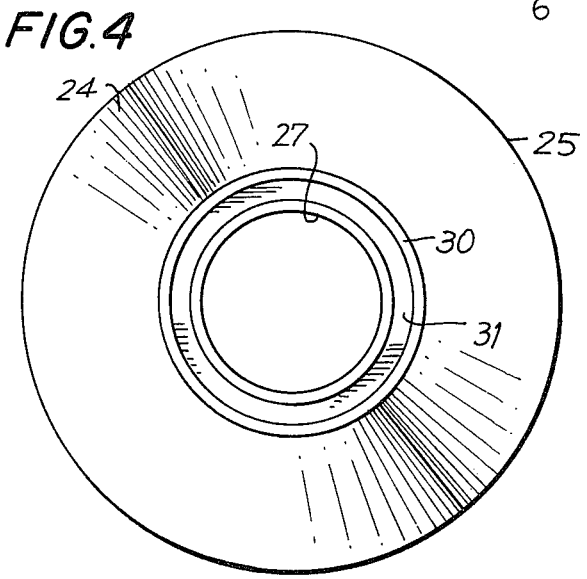
FIG. 4 is a bottom plan view, on an enlarged scale, of the embodiment of FIG. 3 of the funnel of the invention.

DETAILED DESCRIPTION OF A PREFERRED EMBODIMENT OF THE INVENTION:

The bag filling kit of the invention comprises a stand 1 having four side walls 2, 3, 4 and 5 and spaced opposite first and second open ends 6 and 7, respectively (FIGS. 2 and 3). The first open end 6 of the stand 1 is rectangular and, more particularly, square.

The second open end 7 of the stand 1 tapers down to a stand neck smaller than the first end, as shown in the FIGS. The second open end 7 of the stand 1 is circular, as shown in FIG. 2. Slots 8 and 9 are formed in the opposite side walls 2 and 4, respectively, of the stand 1 (FIG. 3).

Figure 1:
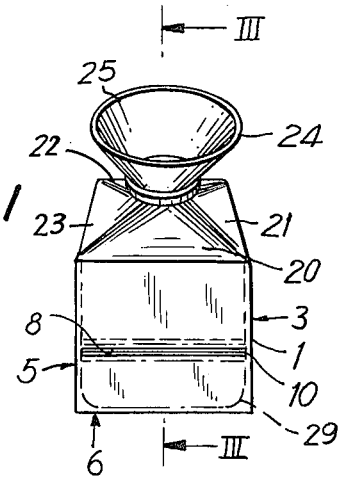
FIG. 1 is a perspective view of an embodiment of the bag filling kit of the invention assembled for use in filling a bag.

A shelf 10 (FIGS. 1 to 3) is removably insertable into the stand 1 via the slots 8 and 9 of the side walls 2 and 4, respectively, thereof, and is supported by said side walls. As shown in FIGS. 2 and 3, the shelf 10 has a substantially planar surface 11 bounded by a front edge 12, a rear edge 13 and a pair of side edges 14 and 15. A trough-like pull member 16 extends from the front edge 12 for facilitating manual movement of the shelf 10 (FIGS. 2 and 3). The pull member 16 is preferably integrally formed with the shelf 10 and has a rear side 17 extending from the front edge 12 of said shelf substantially perpendicularly thereto (FIG. 3), a front side 18 in spaced parallel relation with said rear side (FIGS. 2 and 3) and a top side 19 in spaced parallel relation with the planar surface 11 of said shelf and joining said front and rear sides, as shown in FIGS. 2 and 3. The sides 2, 3, 4 and 5 of the stand 1 taper down to the second open end or neck 7 via inclined sides 20, 21, 22 and 23, respectively (FIG. 1). The side walls 3 and 5 of the stand 1 (FIG. 1) bound the side walls 2 and 4, having the slots 8 and 9 formed therein (FIG. 3). The slots 8 and 9 extend the full distance between the side walls 3 and 5, as shown in FIG. 1. The front and rear edges 12 and 13, respectively, of the shelf 10 are spaced a greater distance than the distance between the side walls 2 and 4, as shown in FIG. 3, so that said shelf extends beyond the stand 1 at the front and rear edges of said shelf.

Figure 5:
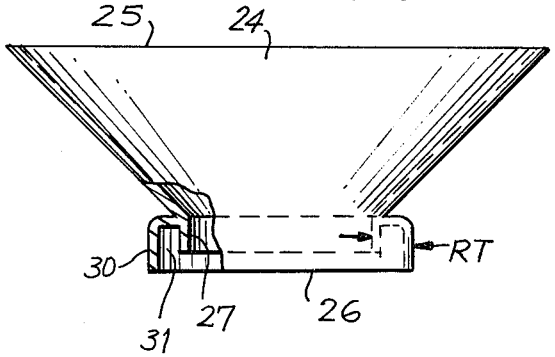
FIG. 5 is a side view, on an enlarged scale, and partly cut away and partly in section, of the embodiment of FIG. 4 of the funnel.

A funnel 24 (FIGS. 1 and 5) has side walls and spaced opposite first and second open ends 25 and 26, respectively (FIGS. 2, 3 and 5). The side walls of the funnel 24 taper down from the first open end 25 to the second open end 26, in the usual manner of funnels (FIGS. 1 to 5). The funnel 24 has a funnel neck 27 (FIGS. 3 to 5) at its second end 26 and a clamping device at said funnel neck. The clamping device is dimensioned to fit over the second end 7 of the stand 1 and functions to releasably clamp the neck 28 of a flexible bag 29 to the outside of said second end of said stand with the remainder of said bag in said stand, said neck of said flexible bag being bent over the outside of said stand neck, as shown in FIG. 3. The bag 29 is thus fillable with material via the funnel 24 when the funnel neck 27 is inserted into the open neck 7 of said bag. The funnel 24 is separate and independent from the stand 1.

The clamping device of the funnel 24 comprises a coaxial collar 30 spaced from and around the funnel neck 27 (FIGS. 2 to 5). The funnel neck 27 has dimensions small enough to fit into the stand neck 7 and the collar 30 has dimensions large enough to fit around said stand neck, as shown in FIG. 3. The collar 30 is spaced from the funnel neck 27 by an annular gap 31 substantially rectangular cross-section (FIGS. 4 and 5) having a radial thickness RT (FIG. 5) sufficient to accommodate the stand neck 7 and the neck 28 of the bag 29 in a substantially snug fit, as shown in FIG. 3.

The neck 28 of the bag 29 is bent over the stand neck 7 of the stand 1 whereby said bag is fillable with material of any suitable type, such as, for example, food for a freezer, via the funnel 24, as shown in FIGS. 1 and 3, when the funnel neck 27 of said funnel is inserted into said open neck of said bag.

The components of the kit of the invention may comprise any suitable material such as, for example, plastic, ceramic, metal, or the like.

Kits similar to the type described in the present application are disclosed in U.S. Pat. Nos. 1,110,018, granted to Van Scholack on Sept. 8, 1919, 2,758,764, granted to Piazze on Aug. 14, 1956, 2,886,073 granted to Beck on May 12, 1959, 2,247,647 granted to Koch on Apr. 16, 1966, and 3,916,962 granted to Slolt on Nov. 4, 1975.

A quart-sized plastic bag 29 is filled by first setting the stand 1 on a supporting surface 32 (FIG. 3). The bag 29 is then placed in the stand 1 via the open stand neck 7 thereof and the neck 28 of said bag is folded over the outside of said stand neck, as shown in FIG. 3. The funnel 24 is then clamped onto the stand 1 by inserting the funnel neck 27 into the bag neck 28 and the stand neck 7 and by placing the collar 30 over said bag neck around the outside of said stand neck. The funnel 24 is thus releasably clamped around the bag neck 28 and the stand neck 7 and extends through said necks.

Material is poured into the bag 29 via the funnel 24. The bag 29 is then lifted high enough so that the neck 28 thereof may be manually held after the funnel is removed. The bag 29 is then sealed by twisting its neck 28 or by applying a rubber band around its neck. The filled bag 29 is permitted to rest on the supporting surface 32, and the stand 1 is lifted off said bag.

When a pint-sized plastic bag 29 is to be filled, the aforedescribed steps are followed with the additional step of first inserting the pint bag support shelf 10 in the stand 1 via the slots 8 and 9 thereof. The pint-sized bag 29 then rests on the surface 11 of the shelf 10, in the stand 1, as shown in FIG. 3.

The bag filling kit of the invention comprises simple and durable parts and components, which are inexpensive in manufacture and assembled with facility, convenience and rapidity. The bag filling kit may be used with facility and convenience by anyone, with or without particular skills. The bag filling kit of the invention retains a bag securely during filling.

While the invention has been described by means of a specific example and in a specific embodiment, I do not wish to be limited thereto, for obvious modifications will occur to those skilled in the art without departing from the spirit and scope of the invention.

I claim:

1. A bag filling kit, comprising a hollow stand having side walls and spaced opposite first and second open ends, the second end of the stand tapering down to a stand neck smaller than the first end;

a funnel having side walls, spaced opposite first and second open ends, a funnel neck at said second end and clamping means at said funnel neck, the side walls tapering down from the first end to the second end, said clamping means comprising a coaxial collar integral with and spaced from and around said funnel neck and concentric with said funnel neck, said funnel neck having dimensions small enough to fit into said stand neck and said collar having dimensions large enough to fit over said stand neck whereby said collar is spaced from said funnel neck by an annular gap having a radial thickness and releasably clamps the neck of a flexible bag to the outside of said stand neck with the remainder of the bag in said stand, said neck of said bag being bent over the outside of said stand neck whereby said bag is fillable with material via said funnel when said funnel neck is inserted into the open neck of said bag, said funnel being separate and independent from said stand, the radial thickness of said annular gap being sufficient to accommodate said stand neck and said neck of said bag in a substantially snug fit, said stand having slots formed in a pair of opposite ones of said side walls; and a shelf removably insertable into said stand via said slots and supported by said side walls, said shelf having a substantially planar surface bounded by a front edge, a rear edge and a pair of side edges and a trough-like pull member formed with said shelf having a rear side extending from said front edge of said shelf substantially perpendicularly thereto including a front side in spaced parallel relation with said rear side and a top side in spaced parallel relation with said planar surface of said shelf and joining said front and rear sides.

2. A bag filling kit as claimed in claim 1, wherein said stand is circular at its second open end.

3. A bag filling kit as claimed in claim 1, wherein said annular gap is of substantially rectangular cross-section.

4. A bag filling kit as claimed in claim 3, wherein said side walls of said stand include an additional pair of opposite side walls bounding said ones of said side walls, said slots extend the full distance between said additional side walls and said front and rear edges of said shelf are spaced a greater distance than the distance between said ones of said side walls.

* * * * *